United States Patent [19]

Voggenthaler et al.

[11] Patent Number: 4,645,581

[45] Date of Patent: Feb. 24, 1987

[54] APPARATUS FOR ELECTROPOLISHING THE INNER SURFACE OF U-SHAPED HEAT EXCHANGER TUBES

[75] Inventors: Ludwig Voggenthaler, Regensburg; Hermann Operschall, Lauf; Jakob Weber, Baiersdorf, all of Fed. Rep. of Germany

[73] Assignee: Kraftwerk Union Aktiengesellschaft, Mülheim, Fed. Rep. of Germany

[21] Appl. No.: 766,773

[22] Filed: Aug. 16, 1985

[30] Foreign Application Priority Data

Aug. 17, 1984 [DE] Fed. Rep. of Germany ..... 3430384

[51] Int. Cl.[4] ..... C25D 17/00

[52] U.S. Cl. ..... 204/275

[58] Field of Search ..... 204/275, 224 R, 225

[56] References Cited

U.S. PATENT DOCUMENTS

| | | | |
|---|---|---|---|
| 3,202,598 | 8/1965 | Covington | 204/224 M |
| 3,223,600 | 12/1965 | Andersson | 204/26 |
| 3,673,073 | 6/1972 | Tobey | 204/275 |

FOREIGN PATENT DOCUMENTS

| | | | |
|---|---|---|---|
| 0074464 | 6/1982 | European Pat. Off. | 204/26 |
| 3029811 | 2/1982 | Fed. Rep. of Germany | 204/26 |
| 3136187 | 4/1983 | Fed. Rep. of Germany | 204/26 |

*Primary Examiner*—T. M. Tufariello

*Attorney, Agent, or Firm*—Herbert L. Lerner; Laurence A. Greenberg

[57] ABSTRACT

Method for electropolishing the inner surface of an U-shaped heat exchanger tube with an electrode connected to a negative pole of a d-c voltage source, the electrode being slidable into the heat exchanger tube and withdrawable out of the tube by a pulling member, and with a pump connected to an electrolyte tank for feeding electrolyte into the heat exchanger tube, which comprises inserting into two chambers, respectively, formed in a bottom hemispherical shell of a heat exchanger, respective manipulators formed with jibs for positioning tube probes by remote control into end openings of U-shaped heat exchanger tubes disposed in the heat exchanger and opening into the chambers; pressing by the manipulators respective adapters, which are connected to hose connectors and are carried at respective free ends of the manipulator jibs, to the end openings of the heat exchanger tubes through the intermediary of respective seals so as to align in each of the chambers the end opening of one of the U-shaped heat exchanger tubes with respective hoses connected thereto by the hose connectors; inserting an electrode by a thrust cable through one of the hoses and into the respective heat exchanger tube up to a given location therein; pumping electrolyte through one of the hoses into the respective heat exchanger tube and conducting it from the other hose into a collecting tray; electrically energizing the electrode and withdrawing it slowly from the respective heat exchanger tube while the electrode remains energized; and thereafter removing the electrolyte from the respective heat exchanger tube.

12 Claims, 4 Drawing Figures

APPARATUS FOR ELECTROPOLISHING THE INNER SURFACE OF U-SHAPED HEAT EXCHANGER TUBES

The invention relates to apparatus for electropolishing the inner surface of U-shaped heat exchanger tubes with an electrode which is connected to the negative pole of a d-c voltage source and which is slidable into the heat exchanger tube and again withdrawable out of the tube via a pulling member, and with a pump connected to an electrolyte tank for supplying the electrolyte; and a method of operating the foregoing apparatus.

A method and apparatus for cleaning the inside walls of metallic pipeline systems by electropolishing by means of displaced electrodes have become known heretofore from German Published Non-Prosecuted Application No. (DE-OS) 31 36 187. In this method, the electrode, which has a diameter matching the inner diameter of the pipeline system to be cleaned, is fastened to the end of a hose through which electrolyte liquid is pumped under high pressure into the pipeline. The head of this electrode has the shape of a mushroom. In it, the electrolyte is deflected about 145° and is sprayed via spraying nozzles backwardly at an inclined angle against the inside wall of the tube. This electrode is drawn more deeply into the tube by the recoil of the electrolyte at the spraying nozzles. The heretofore known electrode carries several discs of insulating material arranged axially spaced from one another, by which the electrode is held at a uniform distance from the inside wall of the pipeline. It is a peculiarity of this device for cleaning the inside walls of metallic pipeline systems that the recoil of the electrolyte is not always sufficient to transport the electrode around pipe elbows. For vertical pipeline sections, the range of usefulness is very limited. In addition, the cleaning of radioactively contaminated pipelines by this method is connected with marked radiation exposure of the testing personnel, because the electrode must be inserted or threaded into every individual pipeline by hand.

It is an object of the invention to develop a method for cleaning the inner surface of pipelines and to embody an apparatus for performing the method so that vertical U-shaped heat-exchanger tubes of steam generators of nuclear power stations can also be decontaminated thereby. In addition, handling the apparatus should require a minimum of radiation exposure for the operating personnel.

With the foregoing and other objects in view, there is provided, in accordance with the invention, a method for electropolishing the inner surface of an U-shaped heat exchanger tube with an electrode connected to a negative pole of a d-c voltage source, the electrode being slidable into the heat exchanger tube and withdrawable out of the tube by a pulling member, and with a pump connected to an electrolyte tank for feeding electrolyte into the heat exchanger tube, which comprises inserting into two chambers, respectively, formed in a bottom hemispherical shell of a heat exchanger, respective manipulators formed with jibs for positioning tube probes by remote control into end openings of U-shaped heat exchanger tubes disposed in the heat exchanger and opening into the chambers; pressing by the manipulators respective adapters, which are connected to hose connectors and are carried at respective free ends of the manipulator jibs, to the end openings of the heat exchanger tubes through the intermediary of respective seals so as to align in each of the chambers the end opening of one of the U-shaped heat exchanger tubes with respective hoses connected thereto by the hose connectors; inserting an electrode by a thrust cable through one of the hoses and into the respective heat exchanger tube up to a given location therein; pumping electrolyte through one of the hoses into the respective heat exchanger tube and conducting it from the other hose into a collecting tray; electrically energizing the electrode and withdrawing it slowly from the respective heat exchanger tube while the electrode remains energized; and thereafter removing the electrolyte from the respective heat exchanger tube.

In accordance with another feature of the invention of the instant application, the electrolyte is pumped into the heat exchanger tube in the same direction in which the electrode is withdrawn from the tube.

In accordance with an additional feature of the invention of the instant application there is provided, forcing compressed gas through the heat exchanger tube for checking the tightness with which the adapters are seated at the end openings of the heat exchanger tube, prior to pumping the electrolyte into the heat exchanger tube.

With the foregoing and other objects in view, there is provided, in accordance with the invention, an apparatus for electropolishing the inner surface of an U-shaped heat exchanger tube having open ends terminating respectively in two chambers formed in a bottom hemispherical shell of a heat exchanger, comprising respective manipulators formed with jibs for positioning tube probes by remote control into the respective end openings of the heat exchanger tube in the respective chambers; respective adapters connected to hose connectors and carried at respective free ends of the manipulator jibs, the adapters being pressable by the manipulators to the end openings of the heat exchanger tube through the intermediary of respective seals so as to align in the chambers the respective end openings of the U-shaped heat exchanger tube with respective hoses connected thereto by the hose connectors; an electrode connected to a negative pole of a d-c voltage source; a thrust cable formed as a smoothly jacketed copper cable and connected to the electrode for inserting the electrode through one of the hoses and the adapter associated therewith into the respective heat exchanger tube up to a given location therein and for withdrawing the electrode from the heat exchanger tube; a sealing device closing a free end of the one hose, the thrust cable extending through the sealing device; and an electrolyte feed system connected to a free end of the other of the hoses for feeding electrolyte through the heat exchanger tube.

In accordance with an added feature of the invention there is provided, in accordance with the invention, a collecting tray for spent electrolyte connected to the free end of the one hose at which the sealing device is located, and a pump connected in the other hose for feeding fresh electrolyte to the heat exchanger tube.

In accordance with a further feature of the invention there is provided, in accordance with the invention, a device for reprocessing electrolyte connected to the collecting tray for spent electrolyte.

In accordance with yet another feature of the invention there is provided, in accordance with the invention, a feeding device connected to the sealing device for longitudinally feeding the thrust cable into the heat exchanger tube.

In accordance with yet an additional feature of the invention, the feeding device includes motor-driven drive rollers clamping the thrust cable therebetween.

In accordance with yet an added feature of the invention, the feeding device includes a cooled take-up roller for the thrust cable.

In accordance with yet a further feature of the invention, the take-up roller is a cylinder.

In accordance with again another feature of the invention, the adapters has at least one hose connection having a diameter matching that of the respective heat exchanger tube, and the respective seals associated with the adapters are ring-shaped and are pressable against a tube sheet of the heat exchanger supporting the heat exchanger tube and are fastenable to the respective manipulator jib.

In accordance with again an additional feature of the invention there is provided, in accordance with the invention, a collecting tray for discharging electrolyte surrounding the respective hose connection and fastened to the respective adapter.

In accordance with again a further feature of the invention there is provided, another collector tray for spent electrolyte connected to the free end of the one hose at which the sealing device is located, a pump connected in the other hose for feeding fresh electrolyte to the heat exchanger tube, and an auxiliary hose connecting the first-mentioned collector tray to the other collector tray.

In accordance with another feature of the invention, each of the two chambers contains one of the manipulators, the jibs of both of the manipulators being positionable in synchronism with both ends of the heat exchanger tube.

In accordance with an added feature of the invention, the respective adapters carry a plurality of hose connections arranged with a mutual spacing therebetween which is substantially the same as the mutual spacing between corresponding heat exchanger tubes disposed in the heat exchanger.

In accordance with a concomitant feature of the invention, the jacket of the copper cable is formed of polytetrafluoroethylene.

Manipulators for the remote-controlled inspection of heat exchanger tubes are known in themselves and are disclosed in German Published Non-prosecuted Application No. (DE-OS) 30 29 811. By using two of such manipulators, it becomes possible to connect the electrode of the electro-polishing device by remote control and with greatly reduced radiation exposure for the operating personnel, to the individual heat exchanger tube of a steam generator. Due to the guidance of the electrode in the hose for respectively feeding and discharging the electrolyte, the direct threading-in or insertion of the electrode into a heat exchanger tube can be avoided and, instead, only a positioning of an adapter provided with a hose connection with respect to the heat exchanger tube is required to be performed via the manipulator.

The use of a solid thrust cable makes it possible to transmit relatively large thrust and tensile forces to the electrode without having to take into account, in this regard, the additional thrust of the flow of the electrolyte. Be electropolishing during the withdrawal of the electrode, the amount of the removal can be set accurately by controlling the pulling rate and the current or flow. If, in addition, the electrolyte liquid is pumped into the heat exchanger tube in the same direction in which the electrode is pulled out of the heat exchanger tube, assurance is provided that once an electrode is inserted, it can also be pulled out again. By means of a thrust device with motor-driven transport rollers, which clamp the thrust member between them, controlled displacement of the electrode which does not overload the thrust cable and its fastening in the electrode is made possible. It is further made possible for the operating personnel to be able to stay in a radiation-protected environment during the decontamination operation.

The use of a common electrolyte tank for flushing down or rinsing the electrode and for feeding the filter loop for the electrolyte make the operation of the latter independent of the feeding of the heat exchanger tube and permits it to perform with relatively small amounts of electrolyte.

Several steam generator tubes can be electropolished simultaneously through the use of adapters with several hose connections. This reduces the operating time of the steam generator and indirectly also the radiation exposure of the operating personnel.

Other features which are considered as characteristic for the invention are set forth in the appended claims.

Although the invention is illustrated and described herein as embodied in method and apparatus for electropolishing the inner surface of U-shaped heat exchanger tubes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
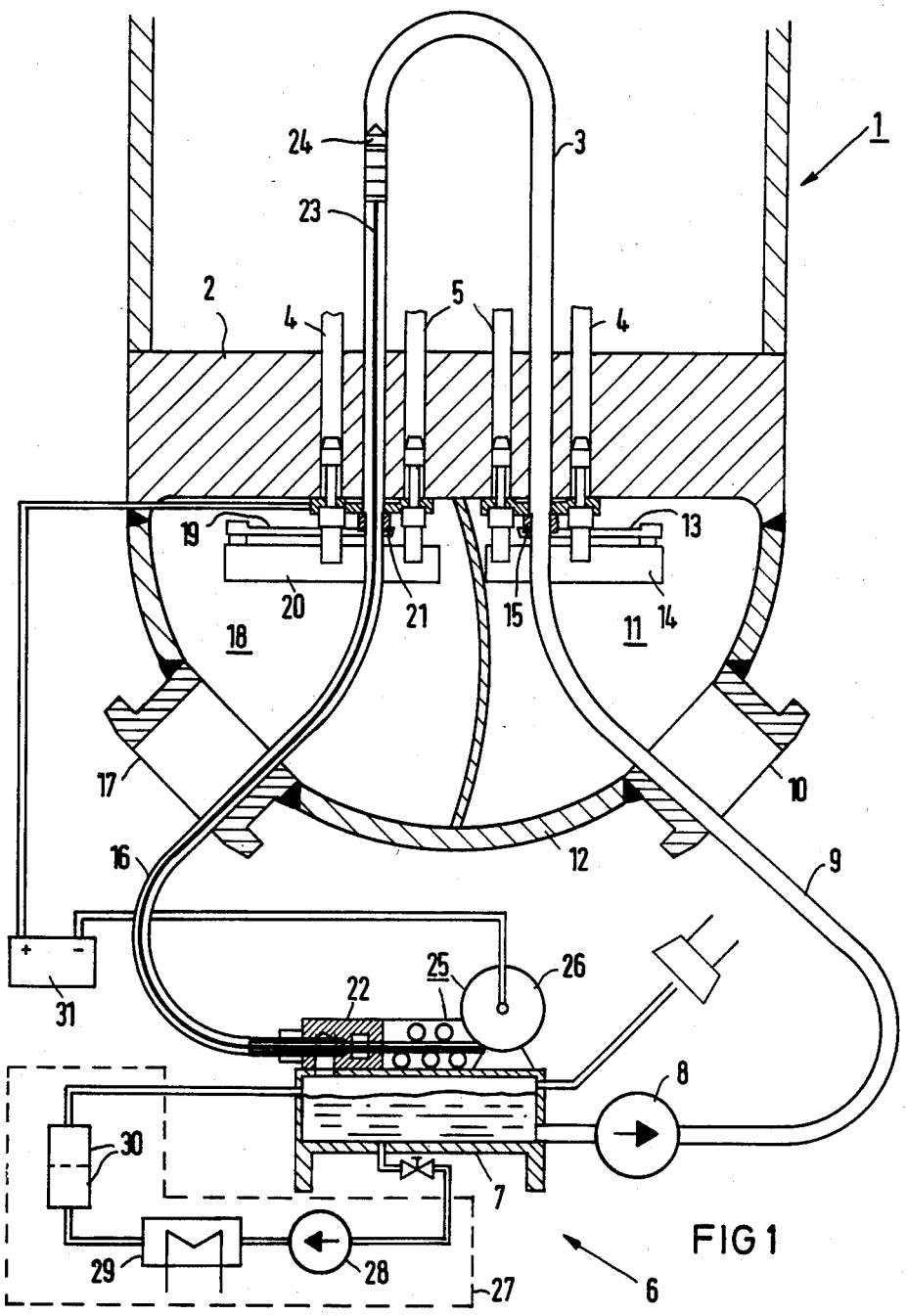
FIG. 1 is a simplified diagrammatic and schematic overview of an apparatus according to the invention for electropolishing the inner surface of U-shaped heat exchanger tubes inserted into a steam generator of a nuclear power station.

Referring now to the drawing and first, particularly, to FIG. 1 thereof, there is shown in a relatively simplified view a steam generator 1 of a type which is common in nuclear power stations for separating the primary circulatory loop of the reactor from the secondary circulatory loop. Three heat exchanger tubes 3, 4 and 5 of the usual multiplicity are shown in the tube sheet 2 of the steam generator 1. In the interest of clarity, the remaining heat exchanger tubes have been omitted. In this steam generator 1, a device 6 according to the invention for electropolishing the inner surface of the heat exchanger tubes is shown in connected condition. This device 6 is made up essentially of an electrolyte tank 7, a pump 8 for the electrolyte, an electrolyte feeding hose 9 which is passed through a man-hole 10 into a chamber 11 at the right-hand side of the bottom calotte 12 of the steam generator 1 as viewed in FIG. 1, and is connected there to an adapter 15 brought into contact by a jib or arm 13 of a manipulator 14 fastened to two heat exchanger tubes 4 and 5 in front of a heat exchanger tube 3. In addition, this device 6 includes a guide hose 16 which extends through another man-hole 17 into a chamber 18 at the left-hand side of the bottom calotte 12 of the steam generator 1, as viewed in FIG. 1, and is connected there to an adapter 21 brought into contact by a jib or arm 19 of another manipulator 20 fastened to two heat exchanger tubes 4 and 5, in front of the other end of the same heat exchanger tube 3. This guide hose 16 is fastened by the end thereof located outside the steam generator to a sealing device 22. A thrust cable 23 extends through this sealing device 22 and carries a flexible electrode 24 at an end thereof located in the guide hose or the heat exchanger tube.

A feeding device 25 with a take-up drum 26 for the thrust cable 23 is fastened to the sealing device 22 which is connected to the electrolyte tank 7. The device 6 for electropolishing the inner surface of the heat exchanger tubes 4, 5, 6 includes, in addition, an electrolyte supply system 27 connected to the electrolyte tank 7 and having a circulating pump 28, a heat exchanger 29 and a filter 30, as well as a d-c voltage source 31 for supplying current to the electrode 24.

Figure 2:
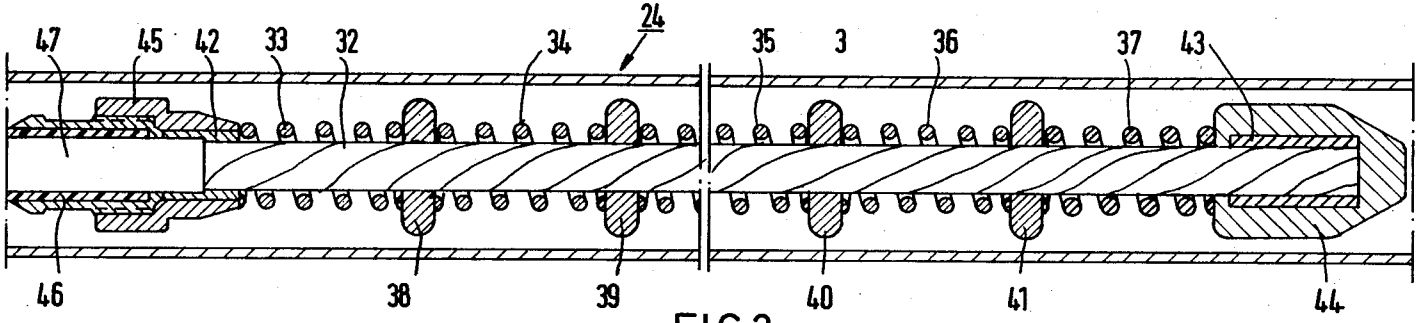
FIG. 2 is an enlarged fragmentary longitudinal sectional view of a heat exchanger tube into which an electrode with a connected thrust cable is introduced.

FIG. 2 shows a construction of the electrode 24 in a cross-sectional view. The electrode 24 is formed of a steel cable 32 onto which springs 33 to 37 and spacers 38 to 41 of insulating material are threaded alternatingly, and in which the first and last spring 33 and 37, respectively, are braced against a respective clamping sleeve 42 and 43 mounted on the steel cable. The front clamping sleeve 43 (as seen in the insertion direction) carries an insertion cone 44 while the rear clamping sleeve 42 is connected to the thrust cable 23 via a cap screw 45. This thrust cable 23 is formed of a smooth copper cable 47 externally coated with plastic material 46.

Figure 3:
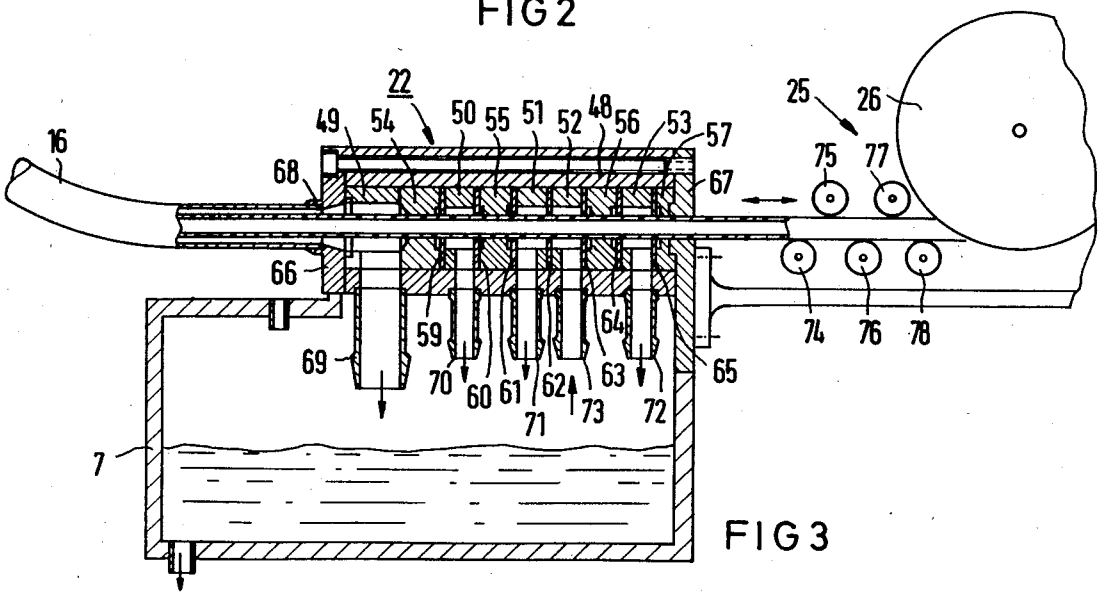
FIG. 3 is an enlarged fragmentary sectional view of FIG. 1 showing a sealing unit with a connected electrolyte tank forming part of the invention.

The construction of the sealing device 22 can be seen in the enlarged view of FIG. 3. This sealing device 22 is formed of a tube section 48 on which rings 49 to 53 of greater inner diameter and rings 54 to 58 of smaller inner diameter are alternatingly threaded, the inner diameter of the rings with the smaller inner diameter corresponding approximately to the outer diameter of the thrust cable 23. Between these rings, there are clamped elastic sealing washers 59 to 65, the inner diameter of which is somewhat smaller than the diameter of the thrust cable 23 extending through them. The two end faces of the sealing device 22 are formed by two discs 66 and 67 of the first disc 66 formed with a bore having an inner diameter which corresponds to that of the guide hose 16 and is provided with a clamping device 68 for fastening the guide hose 16. At the opposite end, the disc 67 is provided with a bore which is matched to the outside diameter of the thrust cable 23. The chambers of the sealing device formed by the discs 66 and 67 with the greater inner diameter are provided with discharge nozzles 69 to 72 and a compressed-air nozzle 73 which terminate in the electrolyte tank 7. On the side of the sealing device 22 facing away from the guide hose 16, a feeding device is fastened which carries several motor-driven rollers 74 to 78 which are pressed against the thrust member 23. Behind the drive rollers 74 to 78, there is likewise provided the motor-driven take-up or winding drum 26 for the thrust cable 23.

Figure 4:
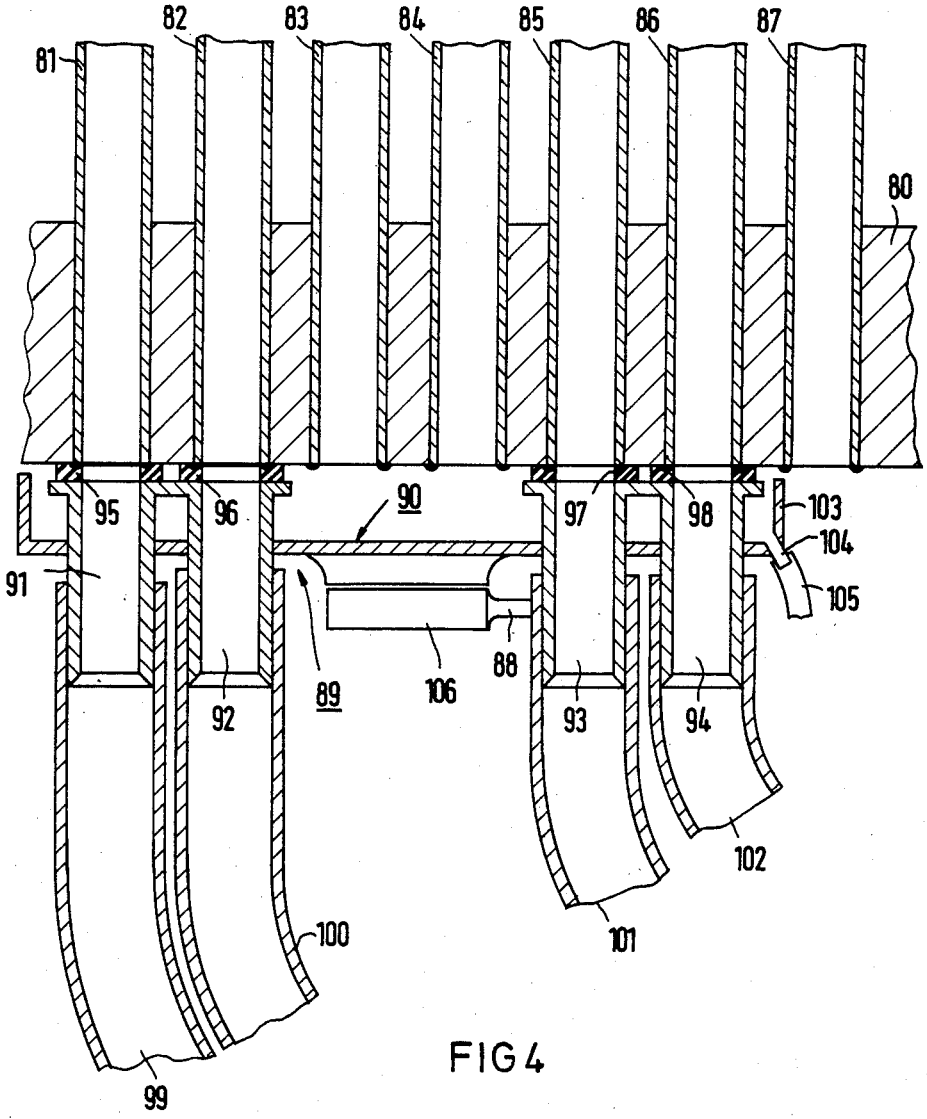
FIG. 4 is an enlarged fragmentary sectional view of FIG. 1 showing another embodiment of an adapter brought into contact with a tube sheet of a steam generator by means of a manipulator arm.

FIG. 4 diagrammatically illustrates a detail of the tube sheet 80 of a steam generator with the different heat exchanger tubes 81 to 87 and, pressed against the tube sheet, an adapter 89 of the jib or arm 88 of a manipulator, otherwise not shown in further detail. The adapter is made up of a collecting tray 90, through which four hose connections 91 to 94 extend in spaced relationship to one another corresponding to the spaced relationship of the heat exchanger tubes 81 to 87 in the tube sheet 80. These hose connections 91 to 94 are widened flange-like at the end thereof facing towards the tube sheet 80 and each carries at the flange periphery thereof a respective soft sealing ring 95 to 98 with which they rest against the welded seams by which the heat exchanger tubes are welded in the tube sheet 80. These hose connections 91 to 94 have the same inner diameter as the heat exchanger tubes 81 to 87. They carry respective guide and electrolyte supply hoses 99 to 102 at the end thereof facing away from the heat exchanger tubes 81 to 82. The collecting tray 90 per se is provided with a rim 103 extending under the tube sheet 80 almost to the latter and has a discharge nozzle 104 which is connected to the electrolyte tank 7 via an auxiliary hose 105. The collecting tray 90 is connected in the center thereof to a coupling disc 106 of the jib or arm 88 of the manipulator. In the embodiment of FIG. 4, the adapter carries four hose connections 91 to 94 arranged in a row behind one another, respective pairs of the hose connections 91 to 94 being arranged side by side or in tandem with the same sparing as that of the heat exchanger tubes.

If the heat exchanger tubes of a steam generator are to be decontaminated or cleaned by electropolishing for other reasons, a respective conventional manipulator 14, 20 can be inserted into the two chambers 11, 18 of the bottom calotte 12 of the steam generator 1 for remote-control inspection of the heat exchanger tubes 3, 4 and 5. An adapter 15, 21 with a respective guide hose 16 and electrolyte feed hose 9 connected thereto is then placed onto the jib or arms 13 and 19 of each of the two manipulators. After the completion of this operation, the work connected with distinct radiation exposure in the bottom calotte 12 of the steam generator 1 is completed, except for the later disassembly of the adapters and manipulators. Outside the steam generator, the electrode 24 with the thrust cable 23 associated therewith is introduced into the guide hose 16 and the guide hose is coupled to the front end of the sealing device 22. Then, the electrolyte feeding hose 9 can be connected to the electrolyte pump 8. The operating personnel can then be removed completely from the radiation region because all further work can be carried out under remote control.

Via the remote control of the two manipulators 14 and 20, the adapters 15 and 21 coupled to the jib or arms thereof can be positioned, with respect to the individual heat exchanger tubes extending through the tube sheet 2, in such a manner that the hose connections can be forced, accurately aligned, to the terminations or end openings of the heat exchanger tubes in the two chambers 11 and 18 of the bottom calotte 12 of the steam generator 1. In this regard, the soft sealing rings 95 to 98 (note FIG. 4) at the flange-like ends of the hose connections are pressed against the welded seam which connects the respective heat exchanger tube to the tube sheet 2. By means of a system for admitting compressed gas or air, not further illustrated in detail, the correct seating of the adapters 15 and 21 and the tightness of the system can be checked. If everything is in working order, the feeding device 25 is switched on. The thrust cable 23 is then inserted, together with the electrode 24 fastened to the end thereof, by the motor-driven rollers 74 to 78 through the guide hose 16 and the adapter 21 into the respective heat exchanger tube 3. The electrode 24 is inserted as far as the heat exchanger tube 3 is to be decontaminated. The flexibility of the electrode 24 permits it also to negotiate narrow heat-exchanger tube elbows. Due to the dry insertion of the electrode against the later flow direction of the electrolyte, assurance is provided that the electrode 7 be pulled out again with the thrust cable and aided by the flow of the electrolyte if jamming of the electrodes occur in th heat exchanger tube. After the electrode 24 has reached the desired most extreme position, which can be controlled via a non-illustrated distance measuring sensor in the feeding device 23, the pump 8 for the electrolyte is switched on and the electrolyte is pumped into the heat exchanger tube 3 via the electrolyte feeding hose 9. The electrolyte flows through the heat exchanger tube 3 past the electrode 24 and between the thrust cable 23 and the guide hose 16 into the first chamber of the sealing device 22. From this first chamber, it flows back into the electrolyte tank 7 through the first nozzle or hose liner 69.

After the heat exchanger tube 7 is filled with electrolyte, the d-c voltage source 31 is switched on and the electrode 24 is withdrawn from the heat exchanger tube against with a predetermined speed by means of the feeding device 25. Due to the current flow between the electrode 24 and the heat exchanger tube 3 connected to the other pole of the d-c voltage source 31, the impurities at the inner surface of the heat exchanger tube as well as protruding unevennesses are preferentially removed. The removed particles are transported to the electrolyte tank 7 with the returning electrolyte. The flow pressure of the electrolyte aids the pull on the thrust cable 23. The electrolyte residue entrained by the thrust cable 23 from the first chamber into the second chamber of the sealing device 22 drips off in the latter or is wiped off when passing the sealing washer 60. Electrolyte residues entrained into the third chamber are blown back into the third chamber when passing the sealing disc 62 separating the third chamber from the fourth chamber, and drip off in the third chamber.

By means of the circulating pump 28 of the electrolyte supply system 27, part of the electrolyte is continuously pumped out of the electrolyte tank 7, conducted through the heat exchanger 29 for cooling and through the filter 30 for cleaning. The purified and cooled electrolyte liquid then arrives again in the electrolyte tank 7. In this manner, the temperature in the electrolyte tank 7 is kept constant, and the electrolyte supply system can continue to operate even if the pump 8, which otherwise pumps the electrolyte into the electrolyte feeding hose 9, is switched off for readjusting the adapters. The instant the electrode 24 is pulled out of a heat exchanger tube 3 and has reached the adapter 21, and the heat exchanger tube 3 is thus electropolished and decontaminated, respectively, the voltage source 31 and the feeding device 25 can be switched off. After the pump 8 for the electrolyte is also switched off, compressed air is blown into the electrolyte feeding hose 9 and the residual electrolyte located in the heat exchanger tube 3 and in the guide hose 16 is blown back into the electrolyte container 7. Then, the adapters 15 and 21 can be positioned in front of a further heat exchanger tube by addressing the two manipulators 14 and 20. There, too, the exact position of the two adapters and the fluid-tightness are checked first by introducing compressed gas, and the next heat exchanger tube can be electropolished merely by switching on the feeding device 25, the pump 8 and the d-c voltage source 31, without requiring anyone to climb into one of the two chambers 11 and 18 of the bottom calotte or hemisphere 12 of the steam generator 1. The radioactive impurities which have passed into the electrolyte during the electropolishing operation are flushed with the electrolyte into the electrolyte tank 7, and ultimately arrive in the filter 30 via the filter circulatory loop. Due to the continuous operation of the filter circulatory loop by means of the circulating pump 28, the activity of the electrolyte as well as the temperature thereof can be kept at a low level. Finally, it is necessary only to dispose of the filter cake.

If an adapter 89 with four hose connections 91 to 94, as shown in FIG. 4, is used, four heat exchanger tubes can be electropolished at the same time with four different feeding and sealing units and four different guide and electrolyte feeding hoses. After the tubes are cleaned, the adapter 89 has to be shifted by the jib or arm 88 of the manipulator only about three heat exchanger tubes and later about another five heat exchanger tubes and pressed against the tube sheet 80 so that the next four heat exchanger tubes can be electropolished. The collecting tray 90 prevents the bottom calotte or hemispherical shell 12 of the steam generator from being soiled if electrolyte liquid should drip out at the sealing rings 95 to 98. The consumption of electrolyte liquid is thus also reduced.

With this apparatus according to the invention, a great advantage is achieved in that the time during which the operating personnel remain in the radiation area, especially in the two chambers in the bottom calotte of the steam generator, can be limited to those times which are required to insert the manipulators and to fasten the adapters on the jibs or arms 13, 19 and 88 of the manipulators 14 and 20, and to disassemble them later again after the decontamination work is finished. All other work can be carried out by remote control. Due to the use of adapters 89 with several hose connections 91 to 94, several steam generator tubes 81, 82, 85 and 86 can be electropolished simultaneously, and the total time during which decontamination is carried out can be sharply curtailed.

The foregoing is a description corresponding, in substance, to German application No. P 34 30 384.7, dated Aug. 17, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Apparatus for electropolishing the inner surface of an U-shaped heat exchanger tube having open ends terminating respectively in two chambers formed in a bottom hemispherical shell of a heat exchanger, comprising respective manipulators formed with arms for positioning tube probes by remote control into the respective end openings of the heat exchanger tube in the respective chambers; respective adapters connected to hose connectors and carried at respective free ends of said manipulator arms, said adapters being pressable by said maipulators to the end openings of the heat exchanger tube through the intermediary of respective seals so as to align in the chambers the respective end openings of the U-shaped heat exchanger tube with respective hoses connected thereto by said hose connectors; an electrode connected to a negative pole of a d-c voltage source; a thrust cable formed as a smoothly jacketed copper cable and connected to the electrode for inserting the electrode through one of said hoses and the adapter associated therewith into the respective heat exchanger tube up to a given heat exchanger tube; a sealing device closing a free end of said one hose, said thrust cable extending through said sealing device; a feeding device connected to said sealing device for longitudinally feeding the thrust cable into the heat exchanger tube; and an electrolyte feed system connected to a free end of the other of said hoses for feeding electrolyte through the heat exchanger tube.

2. Apparatus according to claim 1 including a collecting tray for spent electrolyte connected to said free end of said one hose at which said sealing device is located, and a pump connected in said other hose for feeding fresh electrolyte to the heat exchanger tube.

3. Apparatus according to claim 2 including a device for reprocessing electrolyte connected to said collecting tray for spent electrolyte.

4. Apparatus according to claim 1 wherein said feeding device comprises motor-driven drive rollers clamping said thrust cable therebetween.

5. Apparatus according to claim 4 wherein said feeding device includes a cooled take-up roller for said thrust cable.

6. Apparatus according to claim 5 wherein said take-up roller is a cylinder.

7. Apparatus according to claim 1 wherein each of said adapters has at least one hose connection having a diameter matching that of the respective heat exchanger tube, and the respective seals associated with said adapters are ring-shaped and are pressable against a tube sheet of the heat exchanger supporting the heat exchanger tube and are fastenable to the respective manipulator jib.

8. Apparatus according to claim 7 including a collecting tray for discharging electrolyte surrounding the respective hose connection and fastened to the respective adapter.

9. Apparatus according to claim 8 including another collector tray for spent electrolyte connected to said free end of said one hose at which said sealing device is located, a pump connected in said other hose for feeding fresh electrolyte to the heat exchanger tube, and an auxiliary hose connecting said first-mentioned collector tray to said other collector tray.

10. Apparatus according to claim 1 wherein each of said two chambers contains one of said manipulators, the jibs of both of said manipulators being positionable in synchronism with both ends of the heat exchanger tube.

11. Apparatus according to claim 7 wherein the respective adapters carry a plurality of hose connections arranged with a mutual spacing therebetween which is substantially the same as the mutual spacing between corresponding heat exchanger tubes disposed in the heat exchanger.

12. Apparatus according to claim 1 wherein the jacket of said copper cable is formed of polytetrafluoroethylene.

* * * * *